US011525363B2

(12) United States Patent
Sakamoto et al.

(10) Patent No.: US 11,525,363 B2
(45) Date of Patent: Dec. 13, 2022

(54) TURBINE WHEEL AND WIRE RETENTION PIN FIXATION METHOD FOR TURBINE WHEEL

(71) Applicant: Mitsubishi Heavy Industries, Ltd., Tokyo (JP)

(72) Inventors: Yoshiki Sakamoto, Yokohama (JP); Yasuyuki Watanabe, Yokohama (JP); Yoshitaka Sato, Yokohama (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 17/160,895

(22) Filed: Jan. 28, 2021

(65) Prior Publication Data

US 2021/0310364 A1 Oct. 7, 2021

(30) Foreign Application Priority Data

Feb. 10, 2020 (JP) ..... JP2020-020330

(51) Int. Cl.
*F01D 5/32* (2006.01)

(52) U.S. Cl.
CPC ..... *F01D 5/323* (2013.01); *F05D 2220/32* (2013.01); *F05D 2240/30* (2013.01)

(58) Field of Classification Search
CPC ..... F01D 5/323; F01D 5/326; F01D 5/3007; F01D 5/3015; F01D 5/3053; F05D 2220/32; F05D 2240/30; F05D 2230/64; F05D 2260/30
See application file for complete search history.

(56) References Cited

U.S. PATENT DOCUMENTS 2,753,149 A * 7/1956 Kurti ..... F01D 5/323 416/216
4,344,740 A * 8/1982 Trenschel ..... F01D 5/3015 416/193 A
2011/0014053 A1 1/2011 Eastman et al.
2014/0255196 A1* 9/2014 Anderson ..... F01D 5/326 416/218
2015/0078907 A1* 3/2015 Dimmick, III ..... F01D 5/326 416/220 R

FOREIGN PATENT DOCUMENTS

JP 2011-21605 A 2/2011

* cited by examiner

*Primary Examiner* — Woody A Lee, Jr.
*Assistant Examiner* — Eric A Lange
(74) *Attorney, Agent, or Firm* — Crowell & Moring LLP

(57) ABSTRACT

A turbine wheel that retains a fixation wire to inhibit the movement of turbine rotor blades along mating grooves includes: multiple tab sections that form housing sections that house part of the fixation wire; and a wire retention pin to retain the fixation wire in the housing sections. The tab section has a pin slot extending from the radially inner end toward the radially outward side. The wire retention pin has a first pin section having a width smaller than the pin slot and a second pin section having a width larger than the pin slot. The first pin section has multiple divided pieces. The wire retention pin is arranged such that the first pin section is positioned in the pin slot and the second pin section is positioned in the housing section, and is fixed to the tab section with the divided pieces bent outward.

11 Claims, 7 Drawing Sheets

TURBINE WHEEL AND WIRE RETENTION PIN FIXATION METHOD FOR TURBINE WHEEL

BACKGROUND OF THE INVENTION

1. Field of the Invention

The present invention relates to a turbine wheel of a gas turbine and a wire retention pin fixation method for a turbine wheel.

2. DESCRIPTION OF THE RELATED ART

A gas turbine generally includes: a compressor that compresses air to generate compressed air; a combustor that mixes the compressed air from the compressor with fuel and combusts the mixture to generate a combustion gas; and a turbine that obtains shaft power by the combustion gas from the combustor. The turbine includes a turbine rotor that converts the kinetic energy of the combustion gas into rotational power. The turbine rotor is formed by stacking, in the axial direction, multiple disc-like turbine wheels having a plurality of turbine rotor blades radially arranged around the entire circumference of outer peripheral portions of the turbine wheels.

In one of connecting structures between a turbine wheel and turbine rotor blades, blade embedding sections of the turbine rotor blades are inserted in the rotor axis direction into mating grooves (mating slots), which are provided at an outer peripheral portion of the turbine wheel, to be coupled therewith. The mating grooves of the turbine wheel extend in a direction approximately parallel to the rotor axis direction. The blade embedding sections of the turbine rotor blades are formed into a complementary shape relative to the mating grooves of the turbine wheel. In this connecting structure, the turbine rotor blades are secured to the turbine wheel by the blade embedding sections of the turbine rotor blades engaging with the mating grooves of the turbine wheel due to a radially outward centrifugal force acting on the turbine rotor blades along with the rotation of the turbine rotor.

This connecting structure allows the blade embedding sections of the turbine rotor blades to be moved in the rotor axis direction along the mating grooves of the turbine wheel. Accordingly, there has been provided a technique that inhibits the movement of the turbine rotor blades in the rotor axis direction by using a lockwire (see JP-2011-21605-A, for example). JP-2011-21605-A discloses that a plurality of first retention slots formed at an outer peripheral portion of a turbine wheel align with a plurality of second retention slots formed at blade embedding sections of a plurality of turbine rotor blades, and thereby an annular retention slot is formed to extend around the entire circumference of the outer peripheral portion of the turbine wheel and be opened radially inwardly. By arranging an annular lockwire in the annular retention slot, the movement of the turbine rotor blades along the mating grooves is inhibited. In order to hold the lockwire in the annular retention slot, retaining pins are mounted in the turbine wheel, radially inwardly of the lockwire.

Meanwhile, since a gas turbine obtains shaft power of a turbine rotor from a high-temperature and high-pressure combustion gas, it is necessary to cool each part of the turbine rotor such as a turbine wheel or a turbine rotor blade by using cooling air, and to suppress a temperature increase in each part. In the gas turbine, typically, compressed air bled from a compressor is used as the cooling air. In this case, increasing the flow rate of the cooling air means increasing the flow rate of the compressed air bled from the compressor. Accordingly, if the flow rate of the cooling air is increased, the flow rate of the combustion gas to drive the turbine rotor decreases by a corresponding amount, and thus the overall efficiency of the gas turbine deteriorates.

One of the effective means for attaining high efficiency of a gas turbine is to reduce cooling air for cooling each part of a turbine rotor. In this case, the ambient temperature in wheel spaces formed in front and rear of turbine wheels in the axial direction increases. In view of this, it has been proposed to change the material of turbine wheels to a Ni based alloy that is more heat-resistant than conventionally used 12 Cr steel materials. It should be noted however that there is a concern that if parts formed of a Ni based alloy material are used in a high temperature environment in a state in which they are receiving residual tensile stresses, cracks due to the residual tensile stresses occur.

In the technology described in JP-2011-21605-A, the retaining pins are fixed to the outer peripheral portion of the turbine wheel in order to hold the lockwire in the annular retention slot. In such a lockwire retaining structure that uses retaining pins, the retaining pins are fixed by crimping portions of an outer periphery of a turbine wheel in some cases. In this case, a residual tensile stress is generated in and around the crimped portion of the turbine wheel. In a case where a Ni based alloy material is applied to a turbine wheel having such a retaining pin fixation structure, there is a concern over the occurrences of cracks in the turbine wheel due to residual tensile stresses generated by the crimping.

The present invention has been made to overcome the problems described above, and an object of the present invention is to provide a turbine wheel and a wire retention pin fixation method for a turbine wheel that make it possible to suppress the occurrences of residual tensile stresses at an outer peripheral portion of a turbine wheel at the time of fixation of wire retention pins to retain a fixation wire.

SUMMARY OF THE INVENTION

The present application includes a plurality of means for overcoming the problems described above, and one example thereof is a turbine wheel having attachment sections that are spaced apart at an outer peripheral portion and form mating grooves into which turbine rotor blades are inserted in an axial direction to be fit, the turbine wheel being configured to retain, at the outer peripheral portion, an annular fixation wire to inhibit movement of the turbine rotor blades along the mating grooves. The turbine wheel including: a plurality of tab sections that are provided on one side of the attachment sections in the axial direction and form housing sections together with the attachment sections, the housing sections being opened on both sides in a circumferential direction and on a radially inner side and being capable of housing part of the fixation wire; and a wire retention pin for retaining the fixation wire in the housing sections. Some tab sections of the plurality of tab sections each have a pin slot into which the wire retention pin is capable of being inserted, the pin slot extending from a radially inner end toward a radially outward side of each of the some tab sections. The wire retention pin includes a first pin section having a width smaller than a slot width of the pin slot, and a second pin section that is provided on one side of the first pin section in an axial direction of the wire retention pin and has a width larger than the slot width of the pin slot. The first pin section has, at a tip portion, a plurality of divided pieces that are capable of being brought away from each other. The wire retention pin is arranged such that the first pin section is positioned in the pin slot and the second pin section is positioned in one of the housing sections, and the wire retention pin is fixed to one of the some tab sections with the plurality of divided pieces of the first pin section bent outward.

According to the present invention, there are provided the pin slots extending from the radially inner end toward the radially outward side in some of the tab sections of the turbine wheel which form the housing sections for the fixation wire, and further, there are provided a plurality of divided pieces at the tip portion of the first pin section in the wire retention pin which has the first pin section having the width smaller than the slot width of the pin slot and the second pin section having the width larger than the slot width. Therefore, the wire retention pin can be fixed to one of the tab sections of the turbine wheel by crimping only the wire retention pin without crimping the tab sections of the turbine wheel. Accordingly, the occurrences of residual tensile stresses at the tab sections of the turbine wheel at the time of fixation of the wire retention pin can be suppressed.

Problems, configurations and effects other than those described above become apparent from the following explanation of embodiments.

DESCRIPTION OF THE PREFERRED EMBODIMENTS

Hereinafter, an embodiment of a turbine wheel according to the present invention, and an embodiment of a wire retention pin fixation method for a turbine wheel according to the present invention are explained by using the drawings.

One Embodiment

Figure 1:
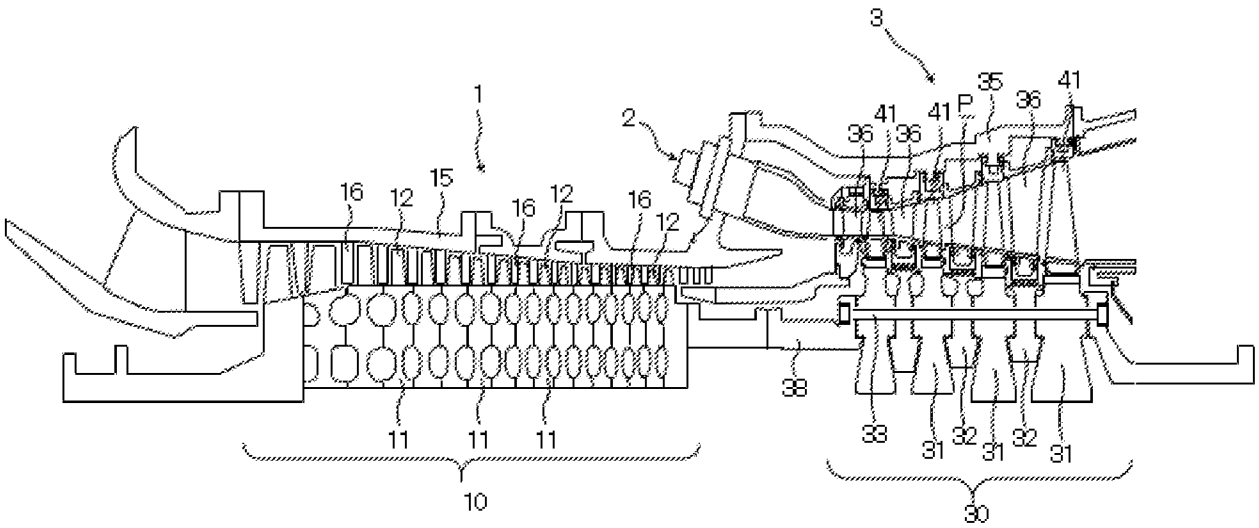
FIG. 1 is a cross-sectional view illustrating a gas turbine including a turbine wheel according to one embodiment of the present invention, in a state in which a lower half section thereof is omitted.

First, the configuration of a gas turbine including a turbine wheel according to one embodiment of the present invention is explained by using FIG. 1. FIG. 1 is a cross-sectional view illustrating the gas turbine including the turbine wheel according to the one embodiment of the present invention, in a state in which a lower half section thereof is omitted.

In FIG. 1, the gas turbine includes a compressor 1, a combustor 2 and a turbine 3. The compressor 1 compresses air that has been sucked in, and generates compressed air. The combustor 2 mixes the compressed air generated by the compressor 1 with fuel from a fuel system (not illustrated), and combusts the mixture to generate a combustion gas. The gas turbine has a multi-can combustor, for example, and in the multi-can type, a plurality of the combustors 2 are arranged annularly at intervals. The turbine 3 is rotation-driven by the high temperature and high-pressure combustion gas generated at the combustor 2, and drives the compressor 1 and a load (a driven device such as a generator, a pump, and a process compressor) which is not illustrated. The turbine 3 is supplied with the compressed air bled from the compressor 1 as cooling air to cool components of the turbine 3.

The compressor 1 includes a compressor rotor 10 that is rotation-driven by the turbine 3, and a compressor casing 15 that houses the compressor rotor 10 such that the compressor rotor 10 can rotate therein. The compressor 1 is an axial compressor, for example. The compressor rotor 10 includes: a plurality of disc-like compressor wheels 11 that are stacked in the axial direction; and a plurality of compressor rotor blades 12 that are coupled to an outer peripheral portion of each compressor wheel 11. In the compressor rotor 10, the plurality of compressor rotor blades 12 that are arrayed annularly at the outer peripheral portion of each compressor wheel 11 form one compressor rotor blade row.

On the downstream side of each compressor rotor blade row in the direction of the flow of a working fluid, a plurality of compressor stator blades 16 are arrayed annularly. The annularly arrayed compressor stator blades 16 form one compressor stator blade row. The compressor stator blade row is secured inside the compressor casing 15. In the compressor 1, each compressor rotor blade row and a compressor stator blade row located immediately downstream of the compressor rotor blade row form one stage.

The turbine 3 includes: a turbine rotor 30 that is rotation-driven by the combustion gas from the combustor 2; and a turbine casing 35 that houses the turbine rotor 30 such that the turbine rotor 30 can rotate therein. The turbine 3 is an axial turbine. A flow passage P through which the combustion gas flows is formed between the turbine rotor 30 and the turbine casing 35.

The turbine rotor 30 is formed by integrally fixing, with stacking bolts 33, a plurality of turbine wheel assemblies 31 that are arrayed in the axial direction, and spacers 32 that are arranged between the plurality of turbine wheel assemblies 31. Each turbine wheel assembly 31 has a plurality of annularly arrayed turbine rotor blades 41 at an outer peripheral portion of the turbine wheel assembly 31. The annularly arrayed turbine rotor blades 41 configure one turbine rotor blade row. Each turbine rotor blade row is arranged in the flow passage P.

On the upstream side of each turbine rotor blade row in the direction of the flow of the working fluid, a plurality of turbine stator blades 36 are arrayed annularly. The annularly arrayed turbine stator blades 36 form one turbine stator blade row. The turbine stator blade row is fixed inside the turbine casing 35, and is arranged in the flow passage P. In the turbine 3, each turbine stator blade row and a turbine rotor blade row located immediately downstream of the turbine stator blade row form one stage.

The turbine rotor 30 is connected to the compressor rotor 10 via an intermediate shaft 38. The turbine casing 35 is connected to the compressor casing 15.

Figure 2:
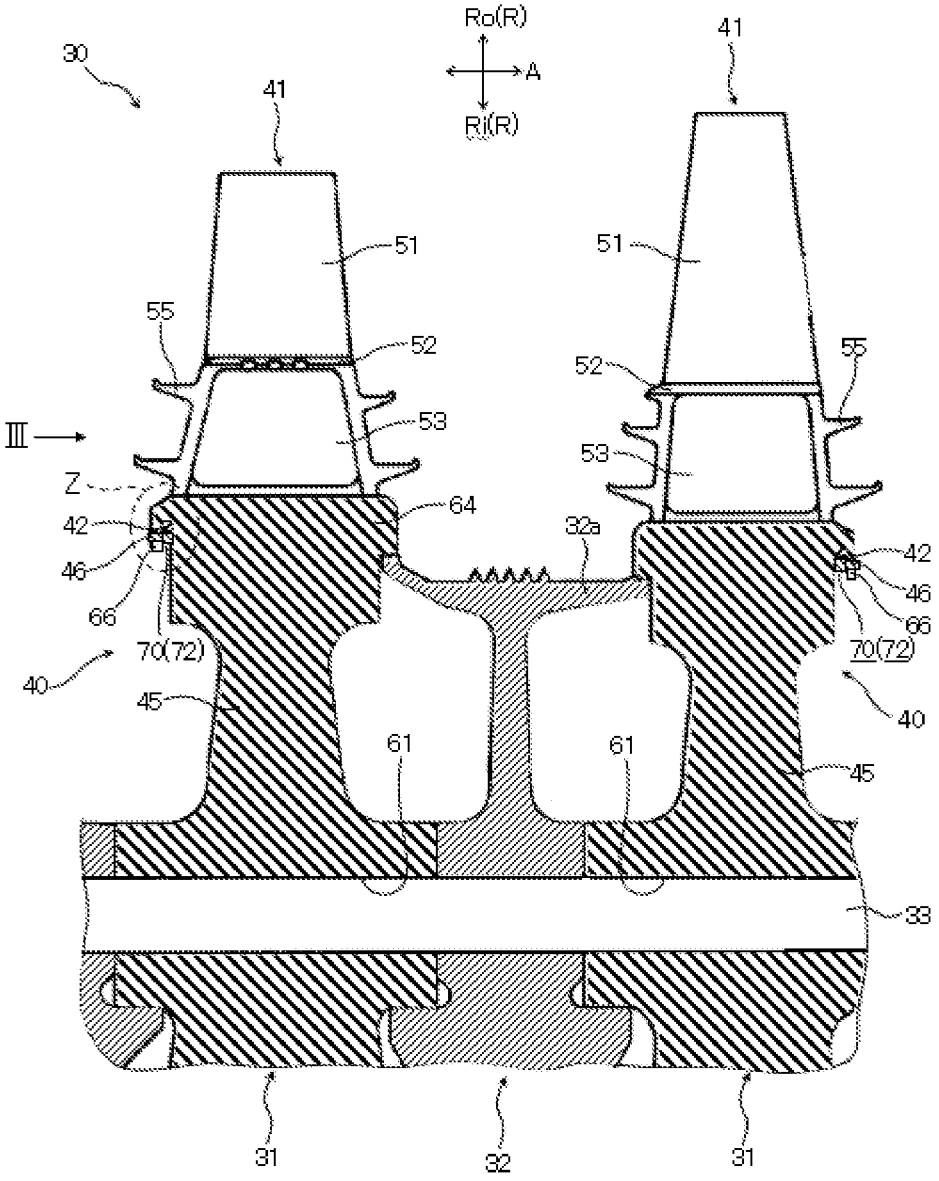
FIG. 2 is an enlarged cross-sectional view illustrating a portion of a turbine rotor including the turbine wheel according to the one embodiment of the present invention illustrated in FIG. 1.
Figure 3:
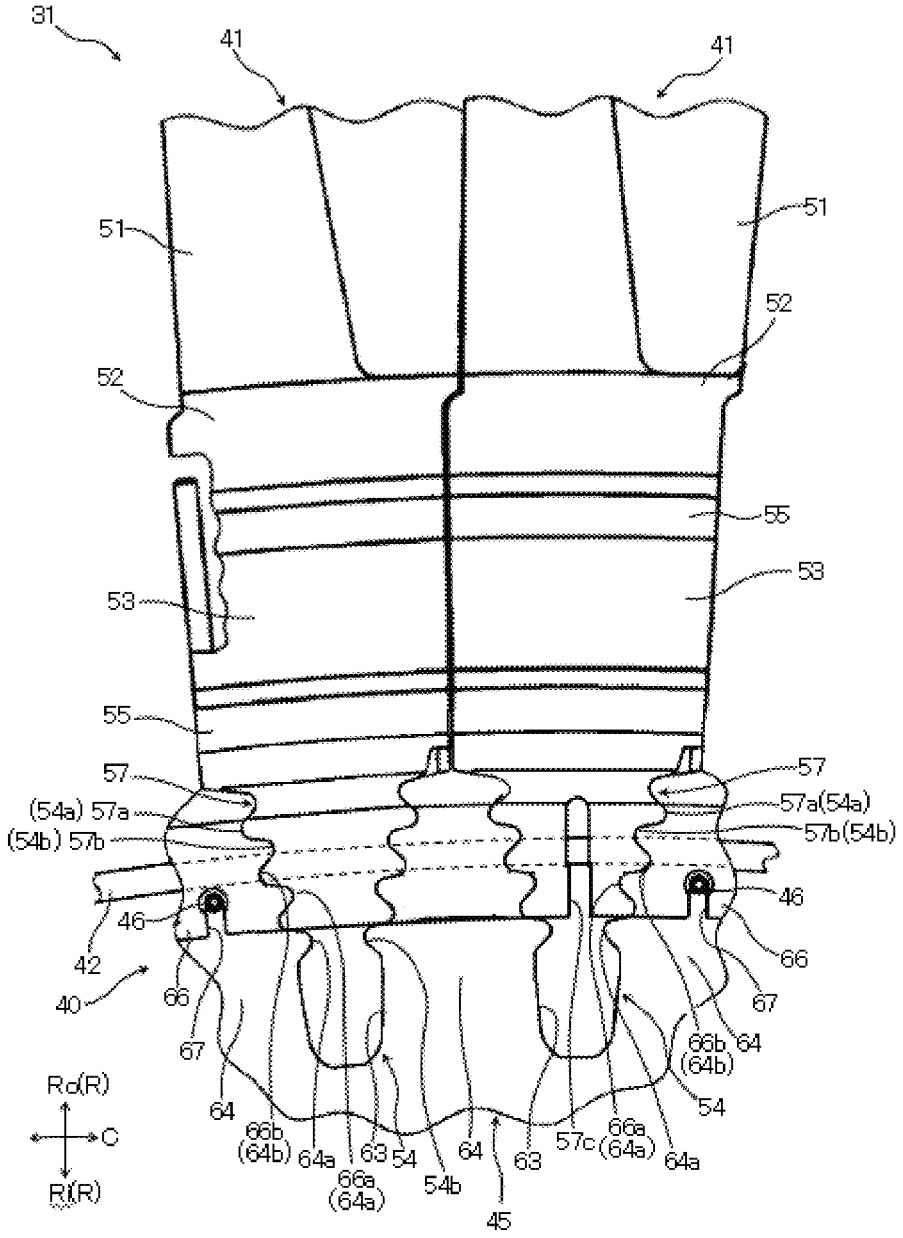
FIG. 3 is a figure, as seen in the direction of an arrow III in FIG. 2, of a turbine-wheel/turbine-rotor-blade connecting structure in the turbine rotor including the turbine wheel according to the one embodiment of the present invention.
Figure 4:
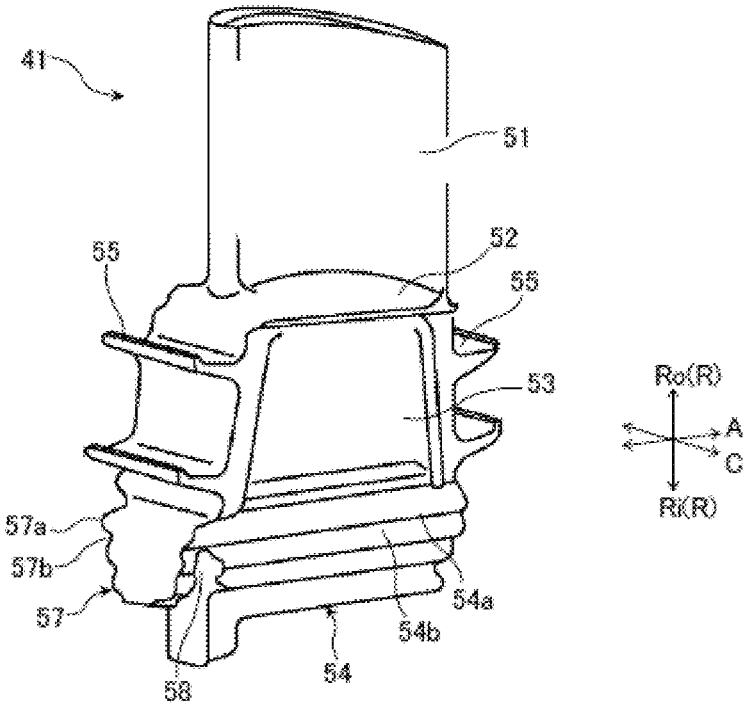
FIG. 4 is a perspective view illustrating a turbine rotor blade connectable to the turbine wheel according to the one embodiment of the present invention.
Figure 5:
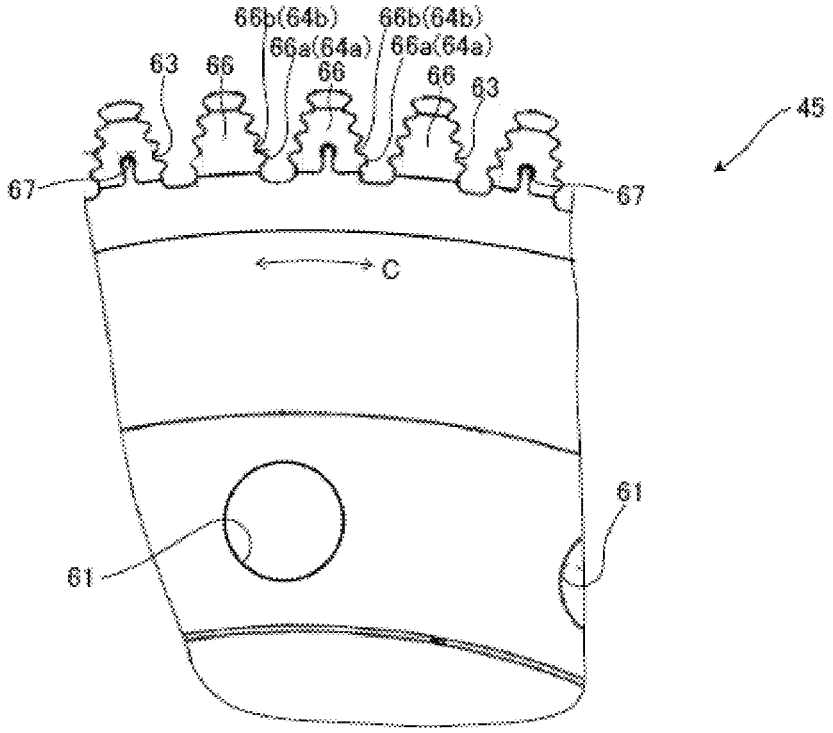
FIG. 5 is a front view illustrating a portion of a wheel body configuring the turbine wheel according to the one embodiment of the present invention.

Next, the configuration of each part of the turbine rotor including the turbine wheel according to the one embodiment of the present invention is explained by using FIG. 2 to FIG. 5. FIG. 2 is an enlarged cross-sectional view illustrating a portion of the turbine rotor including the turbine wheel according to the one embodiment of the present invention illustrated in FIG. 1. FIG. 3 is a figure, as seen in the direction of an arrow III in FIG. 2, of a turbine-wheel/turbine-rotor-blade connecting structure in the turbine rotor including the turbine wheel according to the one embodiment of the present invention. FIG. 4 is a perspective view illustrating a turbine rotor blade connectable to the turbine wheel according to the one embodiment of the present invention. FIG. 5 is a front view illustrating a portion of a wheel body configuring the turbine wheel according to the one embodiment of the present invention.

As illustrated in FIG. 2 and FIG. 3, each turbine wheel assembly 31 of the turbine rotor 30 includes: a disc-like turbine wheel 40; a plurality of turbine rotor blades 41 that are arrayed radially at an outer peripheral portion of the turbine wheel 40; and a fixation wire 42 that inhibits the movement of the turbine rotor blades 41 relative to the turbine wheel 40. The turbine wheel 40 includes: a disc-like wheel body 45 that has an outer peripheral portion in which the plurality of turbine rotor blades 41 can be embedded and the fixation wire 42 can be retained; and wire retention pins 46 that prevent the fixation wire 42 from falling off from the outer peripheral portion of the wheel body 45. Adjacent wheel bodies 45 are mutually coupled via a spacer 32. The spacer 32 has arm sections 32*a* extending toward the adjacent wheel bodies 45 at an outer peripheral portion of the spacer 32. The arm sections 32*a* of the spacer 32 function as sealing sections that seal gaps between the spacer 32 and the adjacent wheel bodies 45. The fixation wire 42 is retained at the outer peripheral portion of the wheel body 45 in the annular state where one end side of the fixation wire 42 overlaps with the other end side thereof.

In FIGS. 2 to 4, each turbine rotor blade 41 has a blade section 51 extending in a radial direction R of the turbine rotor 30, a platform section 52 provided at an end portion of the blade section 51 on a radially inward side Ri (an end portion closer to the root), a shank section 53 extending from the platform section 52 in the direction opposite to the blade section 51, and a blade embedding section 54 provided on the radially inward side Ri of the shank section 53. The blade section 51, the platform section 52, the shank section 53 and the blade embedding section 54 are formed integrally. That is, the turbine rotor blade 41 has a configuration in which the blade section 51, the platform section 52, the shank section 53 and the blade embedding section 54 are formed in this order from the radially outward side Ro toward the radially inward side Ri.

The blade section 51 has a airfoil-like transverse cross-sectional shape, and is arranged in the flow passage P (see FIG. 1) of combustion gas. The platform section 52 defines part of the inner circumferential surface of the flow passage P (see FIG. 1) of combustion gas. The shank section 53 is provided with a plurality of seal fins 55 (four seal fins in FIG. 2 and FIG. 4) that suppress the invasion of the combustion gas, for example. The seal fins 55 extend in an axial direction A of the shank section 53 from wall surfaces on both sides in the axial direction A and have tip portions bent radially outward, for example.

As illustrated in FIGS. 3 and 4, the blade embedding section 54 is a portion to be coupled to the wheel body 45, and has an embedding structure referred to as a Christmas tree type structure, for example. Specifically, for example, the blade embedding section 54 has a plurality of pairs of first hook portions 54*a* that protrude toward both sides in a circumferential direction C and extend in a direction approximately parallel to the axial direction A and a plurality of pairs of first neck portions 54*b* that are recessed in the circumferential direction C relative to the respective pairs of first hook portions 54*a* and extend in the direction approximately parallel to the axial direction A. The pairs of first hook portions 54*a* and the pairs of first neck portions 54*b* are located alternately in the radial direction. In the blade embedding section 54, the lengths, in the circumferential direction C, at the respective pairs of first hook portions 54*a* are set such that they become gradually shorter toward the radially inward side Ri. Similarly, in the blade embedding section 54, the lengths, in the circumferential direction C, at the respective pairs of first neck portions 54*b* are set such that they become gradually shorter toward the radially inward side Ri.

One side of the blade embedding section 54 in the axial direction A is provided with a first tab section 57 that protrudes toward the radially inward side Ri. The first tab section 57 has an uneven shape, similar to the blade embedding section 54, on both sides in the circumferential direction C. That is, the first tab section 57 has a plurality of pairs of first hook portions 57*a* that protrude toward both sides in the circumferential direction C and a plurality of pairs of first neck portions 57*b* that are recessed in the circumferential direction C relative to the respective pairs of the first hook portions 57*a*. The pairs of first hook portions 57*a* and the pairs of first neck portions 57*b* are located alternately in the radial direction. The lengths of the first tab section 57 in the circumferential direction C are also set similarly to the blade embedding section 54. That is, in the first tab section 57, the lengths, in the circumferential direction C, at the respective pairs of first hook portions 57*a* are set such that they become gradually shorter toward the radially inward side Ri. In the first tab section 57, the lengths, in the circumferential direction C, at the respective pairs of first neck portions 57*b* are set such that they become gradually shorter toward the radially inward side Ri.

Together with the blade embedding section 54, the first tab section 57 forms a first housing section 58 that houses part of the fixation wire 42. The first housing section 58 is a space opened toward both sides in the circumferential direction C and toward the radially inward side Ri, and the fixation wire 42 can be inserted in the first housing section 58 from the radially inward side Ri.

As illustrated in FIG. 3, a first tab section 57 of one turbine rotor blade 41 among the turbine rotor blades 41 is provided with a slit 57*c* that extends from the radially inner end of the first tab section 57 toward the radially outward side. The slit 57*c* communicates with a space of the first housing section 58 and is opened at the radially inner end. The slit 57*c* is formed so as to allow the insertion and movement of a tool used for removal of the fixation wire 42. At the time of disassembling of the turbine wheel assembly 31, a specified tool is inserted from the opened side at the radially outer end of the slit 57*c* and is moved to the opened side at the radially inner end of the slit 57*c*. Thereby, the fixation wire 42 can be taken out from an annular wire housing section 72 mentioned below.

The wheel body 45 illustrated in FIGS. 2 and 5 is formed with a Ni based alloy as its base material. An annular thicker portion at an intermediate section of the wheel body 45 in the radial direction R has bolt holes 61 that penetrate the thicker portion in the axial direction A (the thickness direction of the wheel body 45). The bolt holes 61 are provided at predetermined intervals in the circumferential direction C. A stacking bolt 33 is inserted into each bolt hole 61.

As illustrated in FIGS. 3 and 5, the radially outer peripheral portion of the wheel body 45 is provided with a plurality of mating grooves 63 at predetermined intervals in the circumferential direction C. The mating grooves 63 are grooves that extend from one side surface of the wheel body 45 in the axial direction (directions orthogonal to the sheets in FIGS. 3 and 5) to the other side surface, and are opened toward both sides in the axial direction and toward the radially outward side Ro. The mating grooves 63 are formed into a complementary shape relative to the shape of the blade embedding sections 54 of the turbine rotor blades 41, and are portions into which the blade embedding sections 54 of the turbine rotor blades 41 are inserted in the axial direction to be fit.

In other words, as illustrated in FIG. 3, the wheel body 45 has, at predetermined intervals at its outer peripheral portion, a plurality of wheel attachment sections 64 that form the plurality of mating grooves 63. Each wheel attachment section 64 is positioned between adjacent mating grooves 63 and engages with blade embedding sections 54 of the turbine rotor blades 41. The wheel attachment section 64 has a plurality of pairs of second hook portions 64*a* that protrude toward both sides of the wheel body 45 in the circumferential direction C and extend in a direction approximately parallel to the axial direction and a plurality of pairs of second neck portions 64*b* that are recessed in the circumferential direction C relative to the respective pairs of second hook portions 64*a* and extend in the direction approximately parallel to the axial direction. The pairs of second hook portions 64*a* and the pairs of second neck portions 64*b* are located alternately in the radial direction. In the wheel attachment section 64, the lengths, in the circumferential direction, at the respective pairs of second hook portions 64*a* are set such that they become gradually shorter toward the radially outward side Ro. Similarly, in the wheel attachment section 64, the lengths, in the circumferential direction, at the respective pairs of second neck portions 64*b* are set such that they become gradually shorter toward the radially outward side Ro. The pairs of second hook portions 64*a* of the wheel attachment section 64 engage with the first neck portions 54*b* of the blade embedding sections 54 of the turbine rotor blades 41. The pairs of second neck portions 64*b* of the wheel attachment section 64 engage with the first hook portions 54*a* of the blade embedding sections 54 of the turbine rotor blades 41.

As illustrated in FIGS. 2 and 3, one side of each wheel attachment section 64 in the axial direction A is provided with a second tab section 66 that protrudes toward the radially inward side Ri (see FIG. 6 mentioned below also). As illustrated in FIG. 3, the second tab section 66 has an uneven shape, similar to the wheel attachment sections 64, on both sides in the circumferential direction C. That is, the second tab section 66 has a plurality of pairs of second hook portions 66*a* that protrude toward both sides in the circumferential direction C and a plurality of pairs of second neck portions 66*b* that are recessed in the circumferential direction C relative to the respective pairs of second hook portions 66*a*. The pairs of second hook portions 66*a* and the pairs of second neck portions 66*b* are located alternately in the radial direction. The lengths of the second tab section 66 in the circumferential direction C are also set similarly to the wheel attachment sections 64. That is, in the second tab section 66, the lengths, in the circumferential direction C, at the respective pairs of second hook portions 66*a* are set such that they become gradually shorter toward the radially outward side Ro. In the second tab section 66, the lengths, in the circumferential direction C, at the respective pairs of second neck portions 66*b* are set such that they become gradually shorter toward the radially outward side Ro. The pairs of second hook portions 66*a* of the second tab section 66 engage with the first neck portions 57*b* of the first tab sections 57 of the turbine rotor blades 41. The pairs of second neck portions 66*b* of the second tab section 66 engage with the first hook portions 57*a* of the first tab sections 57 of the turbine rotor blades 41.

As illustrated in FIG. 2, together with the wheel attachment section 64, the second tab section 66 forms a second housing section 70 that houses part of the fixation wire 42 (see FIG. 6 mentioned below also). The second housing section 70 is a space opened toward both sides in the circumferential direction and toward the radially inward side Ri, and the fixation wire 42 can be inserted in the second housing section 70 from the radially inward side Ri.

As illustrated in FIG. 3, in a state where the blade embedding sections 54 of the turbine rotor blades 41 are fit into the mating grooves 63 of the wheel body 45, a plurality of the second tab sections 66 of the wheel body 45 and a plurality of the first tab sections 57 of the turbine rotor blades 41 engage alternately, and thereby a plurality of the second housing sections 70 of the wheel body 45 and a plurality of the first housing sections 58 of the plurality of turbine rotor blades 41 are linked alternately to form the annular wire housing section 72. The wire housing section 72 is an annular space opened toward the radially inward side Ri and is a portion in which the fixation wire 42 is inserted from the radially inward side Ri to be housed. By being housed in the annular wire housing section 72, the fixation wire 42 inhibits the movement of the blade embedding sections 54 of the plurality of turbine rotor blades 41 along the mating grooves 63 of the wheel body 45.

Figure 6:
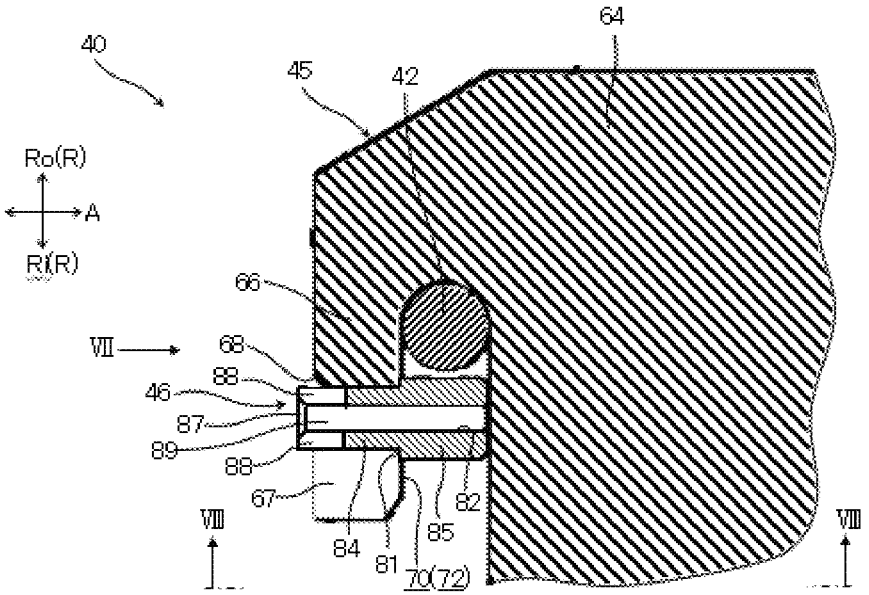
FIG. 6 is a cross-sectional view illustrating a fixation wire retaining structure, which is indicated by a reference character Z in FIG. 2, in the turbine wheel according to the one embodiment of the present invention.
Figure 7:
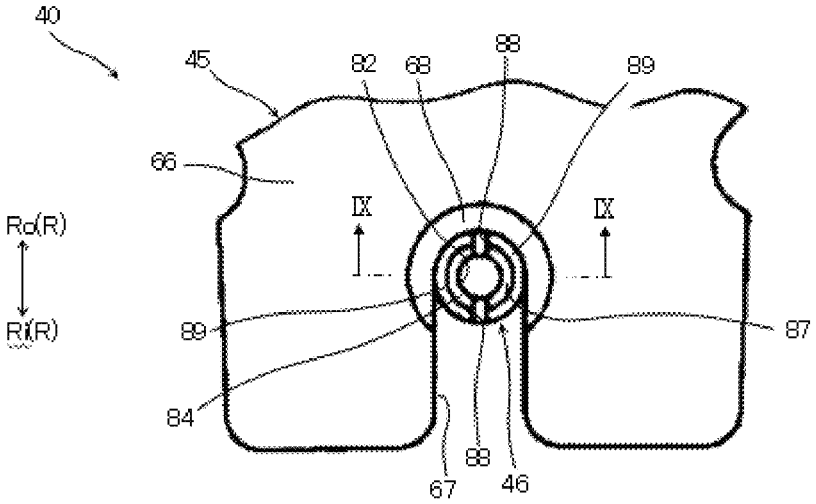
FIG. 7 is a figure, as seen in the direction of an arrow VII in FIG. 6, of the fixation wire retaining structure in the turbine wheel according to the one embodiment of the present invention.
Figure 8:
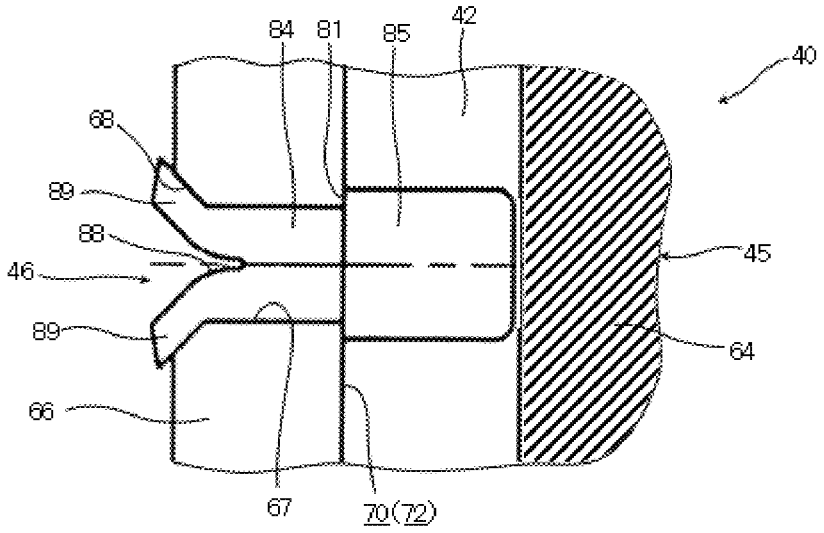
FIG. 8 is a cross-sectional view, as seen in the direction of arrows VIII-VIII in FIG. 6, of the fixation wire retaining structure in the turbine wheel according to the one embodiment of the present invention.
Figure 9:
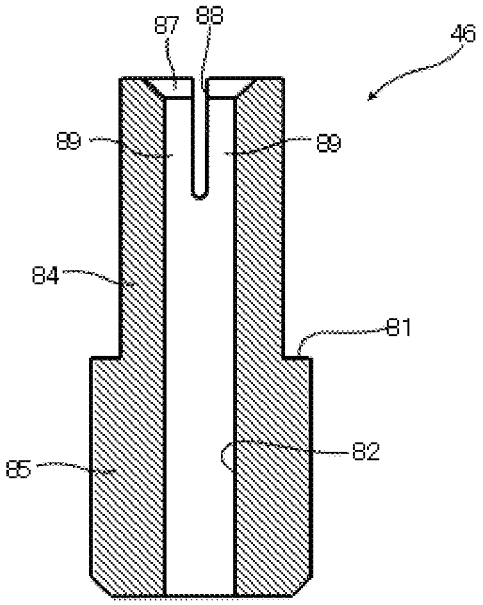
FIG. 9 is a cross-sectional view, as seen in the direction of arrows IX-IX in FIG. 7, of a wire retention pin configuring part of the fixation wire retaining structure in the turbine wheel according to the one embodiment of the present invention.

Next, a fixation wire retaining structure of the turbine wheel according to the one embodiment of the present invention is explained by using FIGS. 5 to 9. FIG. 6 is a cross-sectional view illustrating the fixation wire retaining structure, which is indicated by a reference character Z in FIG. 2, in the turbine wheel according to the one embodiment of the present invention. FIG. 7 is a figure, as seen in the direction of an arrow VI in FIG. 61, of the fixation wire retaining structure in the turbine wheel according to the one embodiment of the present invention. FIG. 8 is a cross-sectional view, as seen in the direction of arrows VIII-VIII in FIG. 6, of the fixation wire retaining structure in the turbine wheel according to the one embodiment of the present invention. FIG. 9 is a cross-sectional view, as seen in the direction of arrows IX-IX in FIG. 7, of a wire retention pin configuring part of the fixation wire retaining structure in the turbine wheel according to the one embodiment of the present invention.

In FIGS. 6 and 7, in the second tab section 66 of the wheel body 45, a pin slot 67 is formed that extends from the radially inner end toward the radially outward side Ro of the second tab section 66. The pin slot 67 is formed such that its radially inner end side is opened while its radially outer end side is positioned on the radially inward side Ri relative to the position of the fixation wire 42 housed at an end section of the second housing section 70 on the radially outward side Ro. The pin slot 67 allows the insertion and movement of the wire retention pin 46. As illustrated in FIG. 5, for example, the pin slot 67 is provided to every other one of the plurality of second tab sections 66 arrayed circumferentially.

As illustrated in FIGS. 6 to 8, in the second tab section 66, a countersunk portion 68 is formed at an opening edge portion, on the outer surface side of the second tab section 66, of an end portion of the pin slot 67 on the radially outward side Ro. The countersunk portion 68 is a portion where a crimped wire retention pin 46 contacts.

As illustrated in FIG. 6, the wire retention pin 46 is used to retain the fixation wire 42 in the wire housing section 72. As illustrated in FIGS. 6 and 8, the wire retention pin 46 is a crimping pin having a stepped structure, and has a step surface 81 that is perpendicular to the axial direction of the wire retention pin 46. Specifically, as illustrated in FIGS. 7 and 8, the wire retention pin 46 includes: a first pin section 84 having a width (outer diameter) slightly smaller than the slot width of the pin slot 67; and a second pin section 85 that is provided on one side of the first pin section 84 in the axial direction in an integrated manner and has a width (outer diameter) larger than the slot width of the pin slot 67. As illustrated in FIGS. 6 and 8, the length of the first pin section 84 is set larger than the thickness of the second tab section 66 of the wheel body 45. The length of the second pin section 85 is set smaller than the width of the second housing section 70 of the wheel body 45. The wire retention pin 46 is formed with a heat-resistant material as its base material.

In addition, as illustrated in FIGS. 7 and 9 for example, the wire retention pin 46 has a hollow section 82 into which a tool can be inserted. An opening edge portion of the hollow section 82 at the first pin section 84 of the wire retention pin 46 is provided with a chamfered portion 87.

As illustrated in FIGS. 6, 7 and 9, a tip portion of the first pin section 84 is provided with two slits 88 that extend in the axial direction of the first pin section 84. The two slits 88 are formed at positions that are point-symmetric about the center line of the wire retention pin 46. That is, the first pin section 84 has a structure that is divided into two at the tip portion thereof, and has two divided pieces 89 that are divided separably from each other at the tip portion.

As illustrated in FIGS. 6 and 7, the wire retention pin 46 is arranged such that the array direction of the two slits 88 becomes approximately parallel to the extending direction of the pin slot 67. In other words, the wire retention pin 46 is arranged such that the array direction of the two divided pieces 89 is approximately perpendicular to the extending direction of the pin slot 67. As illustrated in FIG. 8, the wire retention pin 46 is arranged such that the first pin section 84 is positioned in the pin slot 67, and the second pin section 85 is positioned in the second housing section 70. Additionally, the wire retention pin 46 is configured to be fixed to the second tab section 66 by the two divided pieces 89 at the tip portion of the first pin section 84 being each bent outward, and each pressed against the front surface of the countersunk portion 68 of the second tab section 66 of the wheel body 45. In addition, the wire retention pin 46 is configured such that the step surface 81 is pressed against a wall surface of the second tab section 66 on the second housing section 70 side.

Figure 10:
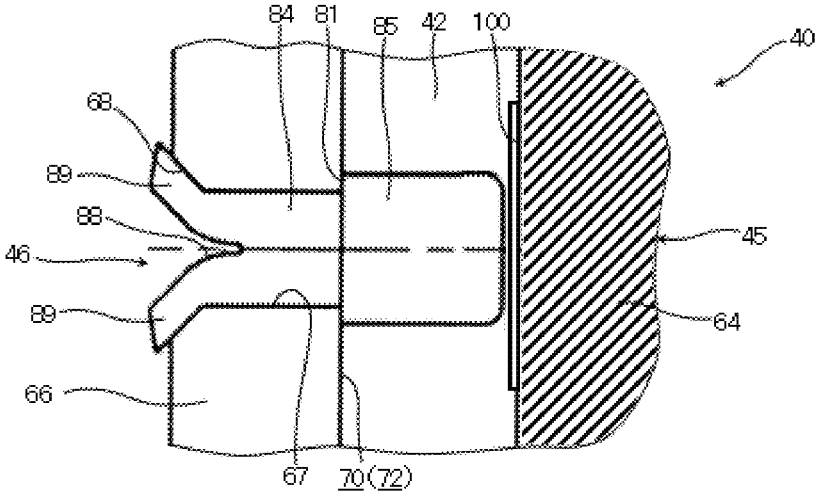
FIG. 10 is an explanatory diagram illustrating one example of one procedure of fixing a wire retention pin in the turbine wheel according to the one embodiment of the present invention.

Next, a wire retention pin fixation method for a turbine wheel according to an embodiment of the present invention is explained by using FIGS. 2 to 7, and 10. FIG. 10 is an explanatory diagram illustrating one example of one procedure of fixing a wire retention pin in the turbine wheel according to the one embodiment of the present invention.

As the first step of preliminary steps, the plurality of turbine rotor blades 41 are built into the wheel body 45. Specifically, the blade embedding section 54 of the turbine rotor blade 41 illustrated in FIG. 4 is inserted in the axial direction into each of the mating grooves 63 of the wheel body 45 illustrated in FIG. 5 to be fit. Thereby, as illustrated in FIG. 3, the second tab sections 66 of the wheel body 45 and the first tab sections 57 of the turbine rotor blades 41 engage alternately, and the plurality of second housing sections 70 of the wheel body 45 and the plurality of first housing sections 58 of the plurality of turbine rotor blades 41 are linked alternately to form the annular wire housing section 72.

As the second step of the preliminary steps, as illustrated in FIG. 2 and FIG. 3, the fixation wire 42 is housed in the wire housing section 72. Specifically, the fixation wire 42 is inserted through the opening of the wire housing section 72 on the radially inward side Ri, and one end portion of the fixation wire 42 is placed on the other end portion thereof to form the fixation wire 42 into an annular shape. Thus, the annular fixation wire 42 is arranged in the annular wire housing section 72.

After the end of the preliminary steps, the wire retention pin 46 is fixed to the wheel body 45 as illustrated in FIG. 6 in order to retain the fixation wire 42 in the wire housing section 72. Specifically, first, the first pin section 84 of the wire retention pin 46 is inserted into the pin slot 67 of each of the second tab sections 66 of the wheel body 45 from the opened side at the radially inner end of the pin slot 67 in a state in which the second pin section 85 of the wire retention pin 46 is positioned on the second housing section 70 side. As illustrated in FIG. 7, at this time, the wire retention pin 46 is arranged such that the array direction of the two divided pieces 89 of the first pin section 84 of the wire retention pin 46 is approximately perpendicular to the extending direction of the pin slot 67.

Next, the wire retention pin 46 is moved along the pin slot 67, and caused to abut on the end portion of the pin slot 67 on the radially outward side Ro. Thereby, as illustrated in FIG. 6, the second pin section 85 of the wire retention pin 46 is located in the second housing section 70 at a position on the radially inward side Ri relative to the fixation wire 42.

Thereafter, as illustrated in FIG. 10, a shim 100 is arranged in a gap between the end face of the second pin section 85 of the wire retention pin 46 and the wall surface, in the axial direction, of the wheel attachment section 64 of the wheel body 45. This can press the step surface 81 of the wire retention pin 46 against the wall surface of the second tab section 66 on the second housing section 70 side.

In a state in which the step surface 81 of the wire retention pin 46 is pressed against the wall surface of the second tab section 66, the wire retention pin 46 is crimped such that the two divided pieces 89 are each bent outward to be pressed against the countersunk portion 68 on the front surface of the second tab section 66. Specifically, for example, a tool is inserted into the hollow section 82 of the wire retention pin 46 illustrated in FIG. 7. Thereby, as illustrated in FIG. 10, the two divided pieces 89 are pressed and bent individually outward easily, and are pressed against the countersunk portion 68 on the front surface of the second tab section 66. After the wire retention pin 46 is crimped and fixed to the second tab section 66, the shim 100 is taken out to be collected.

In this manner, in the present embodiment, the wire retention pin 46 is inserted into the pin slot 67 such that the first pin section 84 of the wire retention pin 46 is positioned at the pin slot 67 of the second tab section 66 and that the second pin section 85 is positioned in the second housing section 70 of the wheel body 45, the wire retention pin 46 is caused to abut on the end portion of the pin slot 67 on the radially outward side Ro, and the two divided pieces 89 of the wire retention pin 46 are bent outward to be pressed against the second tab section 66. Thus, the wire retention pin 46 is fixed to the second tab section 66. Accordingly, the wire retention pin 46 can be fixed to the second tab section 66 without crimping the second tab section 66 of the wheel body 45.

In addition, by fixing the plurality of wire retention pins 46 to the second tab sections 66 at positions on the radially inward side Ri relative to the fixation wire 42 arranged in the second housing sections 70, the movement of the fixation wire 42 toward the radially inward side Ri can be restricted. Accordingly, it is possible to prevent the fixation wire 42 from falling off from the wire housing section 72, and retain the fixation wire 42 in the wire housing section 72.

In addition, the fixation wire 42 is retained in the wire housing section 72 by the wire retention pins 46, and thus the fixation wire 42 extends to lie over the wheel attachment sections 64 of the wheel body 45 that are adjacent to the blade embedding section 54 of the turbine rotor blades 41. Because of this, the fixation wire 42 can inhibit the movement of the blade embedding sections 54 of the turbine rotor blades 41 along the mating grooves 63 of the turbine wheel 40.

As mentioned above, according to the one embodiment of the turbine wheel of the present invention, and the embodiment of the wire retention pin fixation method for the turbine wheel of the present invention, some of the second tab sections (tab sections) 66 of the turbine wheel 40 that form the second housing sections (housing sections) 70 for the fixation wire 42 are provided with the pin slots 67 that extend from the radially inner end toward the radially outward side Ro of the second tab sections 66, and further, the tip portion of the first pin section 84 in each wire retention pin 46 having the first pin section 84 having the width smaller than the slot width of the pin slot 67 and the second pin section 85 having the width larger than the slot width is provided with the two divided pieces 89 (a plurality of divided pieces). The wire retention pins 46 can be therefore fixed to the second tab sections 66 (tab sections) by crimping only the wire retention pins 46 without crimping the second tab sections (tab sections) 66 of the turbine wheel 40. Accordingly, the occurrences of residual tensile stresses at the second tab sections (tab sections) 66 of the turbine wheel 40 at the time of fixation of the wire retention pins 46 can be suppressed.

In addition, according to the present embodiment, the wire retention pin 46 is given the stepped structure having the step surface 81, and further, the step surface 81 of the wire retention pin 46 is configured to be pressed against the wall surface of the second tab section 66 of the turbine wheel 40 on the second housing section 70 side. Thus, the area of contact between the wire retention pin 46 and the second tab section 66 increases, and the wire retention pin 46 can be fixed more rigidly.

Furthermore, according to the present embodiment, in the pin slot 67 formed in the second tab section 66 of the turbine wheel 40, the countersunk portion 68 is provided at the opening edge portion, on the outer surface of the second tab section 66, of the end portion of the pin slot 67 on the radially outward side Ro. Thus, the area of contact between the wire retention pin 46 and the second tab section 66 increases, and the wire retention pin 46 can be fixed more rigidly.

In addition, according to the present embodiment, since the wire retention pin 46 is provided with the hollow section 82, the divided pieces 89 of the wire retention pin 46 can be crimped easily by inserting a specified tool into the hollow section 82 of the wire retention pin 46 from the first pin section 84 side. Accordingly, the ease of assembly of the turbine wheel assembly 31 improves.

Furthermore, according to the present embodiment, since the opening edge portion of the hollow section 82 in the first pin section 84 of the wire retention pin 46 is provided with the chamfered portion 87, a specified tool can be inserted into the hollow section 82 easily, and the divided pieces 89 of the wire retention pin 46 can be crimped easily. Accordingly, the ease of assembly of the turbine wheel assembly 31 improves.

In addition, according to the present embodiment, since the wire retention pin 46 has two divided pieces 89, the wire retention pin 46 can be easily removed from the second tab section 66 of the turbine wheel 40 when the turbine wheel assembly 31 is disassembled.

In addition, according to the present embodiment, since the wire retention pin 46 is arranged such that the array direction of the two divided pieces 89 of the wire retention pin 46 is perpendicular to the extending direction of the pin slot 67 provided to the second tab section 66 of the turbine wheel 40, it is possible to surely press the two divided pieces 89 against the second tab section 66 when the two divided pieces 89 are crimped.

In addition, according to the present embodiment, the shim 100 is arranged in the gap between the wire retention pin 46 and the wheel attachment section 64 after the wire retention pin 46 is caused to abut on the end portion of the pin slot 67 on the radially outward side Ro, and the shim 100 is taken out after the fixation of the wire retention pin 46. Thus, the divided pieces 89 of the wire retention pin 46 can be crimped in a state in which the second pin section 85 of the wire retention pin 46 is pressed against the second tab section 66 of the turbine wheel 40, and the wire retention pin 46 can be fixed to the second tab section 66 more rigidly.

Modification of One Embodiment

Figure 11:
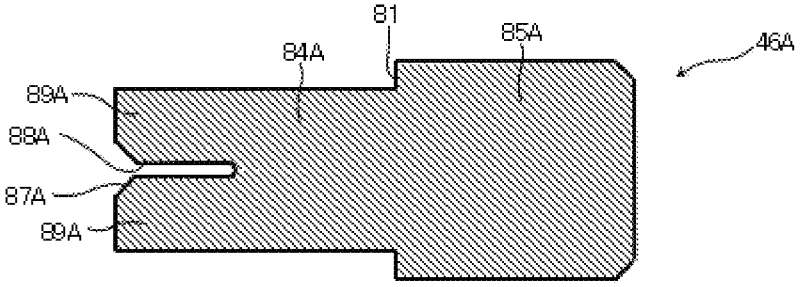
FIG. 11 is a cross-sectional view illustrating a wire retention pin configuring a turbine wheel according to a first modification of the one embodiment of the present invention.
Figure 12:
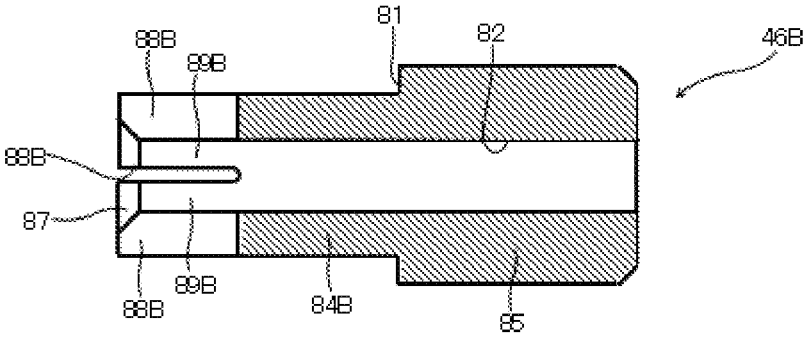
FIG. 12 is a cross-sectional view illustrating a wire retention pin configuring a turbine wheel according to a second modification of the one embodiment of the present invention.

Next, a first modification and a second modification of the one embodiment of the turbine wheel according to the present invention are explained by using FIGS. 11 and 12. FIG. 11 is a cross-sectional view illustrating a wire retention pin in a turbine wheel according to a first modification of the one embodiment of the present invention. FIG. 12 is a cross-sectional view illustrating a wire retention pin in a turbine wheel according to a second modification of the one embodiment of the present invention. Note that in FIGS. 11 and 12, since those having the same reference characters as the reference characters illustrated in FIGS. 1 to 10 are similar portions, detailed explanations thereof are omitted.

In the first modification of the one embodiment of the turbine wheel according to the present invention illustrated in FIG. 11, a wire retention pin 46A has a solid structure, while the wire retention pin 46 of the one embodiment has the hollow structure (see FIG. 9). Specifically, the wire retention pin 46A is a crimping pin having a stepped solid structure including a first pin section 84A and a second pin section 85A similarly to the first embodiment. The first pin section 84A is provided with a linear groove 88A that divides the tip portion into two. That is, the first pin section 84A has at the tip portion of the first pin section 84A two divided pieces 89A that are divided by the groove 88A and can be brought away from each other. The opening edge of the groove 88A of the first pin section 84A on the end face side is provided with a chamfered portion 87A.

The wire retention pin 46A is arranged such that the longitudinal direction of the groove 88A of the first pin section 84A becomes approximately parallel to the extending direction of the pin slot 67. In other words, the wire retention pin 46A is arranged such that the array direction of the two divided pieces 89A is approximately perpendicular to the extending direction of the pin slot 67. The wire retention pin 46A is configured to be fixed to the second tab section 66 by the two divided pieces 89A at the tip portion of the first pin section 84A being each bent outward, and pressed against the front surface of the countersunk portion 68 of the second tab section 66 of the wheel body 45. The wire retention pin 46A can be crimped by pressing and spreading the two divided pieces 89A outward with a tool such as a flathead screwdriver.

In the second modification of the one embodiment of the turbine wheel according to the present invention illustrated in FIG. 12, a tip portion of a first pin section 84B of a wire retention pin 46B has a structure that is divided into four, while the tip portion of the first pin section 84 of the wire retention pin 46 of the one embodiment has the structure that is divided into two (see FIGS. 7 and 9). Specifically, the tip portion of the first pin section 84B is provided with four slits 88B that extend in the axial direction of the first pin section 84B. The four slits 88B are formed at positions at angular intervals of 90 degrees around the center point of the wire retention pin 46B as their center. That is, the first pin section 84B has at the tip portion four divided pieces 89B that are divided separably from each other. The wire retention pin 46B is configured to be fixed to the second tab section 66 by the four divided pieces 89B at the tip portion of the first pin section 84B being each bent outward, and each pressed against the second tab section 66 of the wheel body 45.

According to the first modification and the second modification of the one embodiment of the turbine wheel of the present invention mentioned above, the wire retention pins 46A and 46B can be fixed to the tab section 66 by crimping only the wire retention pins 46A and 46B without crimping the second tab section 66 of the turbine wheel 40, similarly to the one embodiment mentioned before. Accordingly, the occurrences of residual tensile stresses at the second tab section 66 of the turbine wheel 40 at the time of fixation of the wire retention pins 46A and 46B can be suppressed.

In addition, according to the first modification of the one embodiment of the turbine wheel of the present invention mentioned above, since the wire retention pin 46A has the solid structure, the wire retention pin 46A can be fabricated more easily than the wire retention pin 46 having the hollow structure in the one embodiment.

In addition, according to the second modification of the one embodiment of the turbine wheel of the present invention mentioned above, since the wire retention pin 46B has the four divided pieces 89B (since the tip portion of the wire retention pin 46B has the structure that is divided into four), it is not necessary to adjust the positions of the four divided pieces 89B of the wire retention pin 46B relative to the extending direction of the pin slot 67 when the wire retention pin 46B is inserted into the pin slot 67. That is, even if the first pin section 84B of the wire retention pin 46B is inserted into the pin slot 67 in a state in which the four divided pieces 89B are located at any positions, at least two divided pieces 89B among the four divided pieces 89B can be pressed against the second tab section 66. In contrast, in the case of the wire retention pin 46 in the one embodiment, there is a fear that if the first pin section 84 is inserted into the pin slot 67 in a state in which the array direction of the two divided pieces 89 coincides with the extending direction of the pin slot 67, one of the divided pieces 89 cannot be pressed against the second tab section 66. Accordingly, the ease of assembly of the wire retention pin 46B improves more than in the case of the one embodiment.

Other Embodiments

Note that the present invention is not limited to the one embodiment and the modifications of the one embodiment mentioned above, but includes various modifications. The embodiments described above are explained in detail in order to explain the present invention in an easy-to-understand manner, and the present invention is not necessarily limited to embodiments including all the configurations explained. For example, it is possible to replace some of the configurations of an embodiment with configurations of another embodiment, and it is also possible to add configurations of an embodiment to the configurations of another embodiment. In addition, some of the configurations of each embodiment can have other additional configurations, can be removed, or replaced with other configurations.

For example, although the wire retention pins 46, 46A and 46B have the two or four divided pieces 89, 89A or 89B in the configuration examples illustrated in the one embodiment and the modifications of the one embodiment mentioned above, the number of the divided pieces of wire retention pins may be a number other than two and four in another possible configuration. That is, a plurality of divided pieces may be provided at a tip portion of a first pin section of a wire retention pin in a possible configuration. By crimping the plurality of divided pieces of the wire retention pin, the wire retention pin can be fixed to the second tab section 66 without crimping the second tab section 66.

What is claimed is:

1. A turbine wheel having attachment sections that are spaced apart at an outer peripheral portion and form mating grooves into which turbine rotor blades are inserted in an axial direction to be fit, the turbine wheel being configured to retain, at the outer peripheral portion, an annular fixation wire to inhibit movement of the turbine rotor blades along the mating grooves, the turbine wheel comprising:

a plurality of tab sections that are provided on one side of the attachment sections in the axial direction and form housing sections together with the attachment sections, the housing sections being opened on both sides in a circumferential direction and on a radially inner side and being capable of housing part of the fixation wire; and at least one wire retention pin for retaining the fixation wire in the housing sections, wherein some tab sections of the plurality of tab sections each have a pin slot into which the at least one wire retention pin is capable of being inserted, the pin slot extending from a radially inner end toward a radially outward side of each of the some tab sections, and the at least one wire retention pin includes:

a first pin section having a width smaller than a slot width of the pin slot, and a second pin section that is provided on one side of the first pin section in an axial direction of the at least one wire retention pin and has a width larger than the slot width of the pin slot, the first pin section has, at a tip portion, a plurality of divided pieces that are capable of being brought away from each other, and the at least one wire retention pin is arranged such that the first pin section is positioned in the pin slot and the second pin section is positioned in one of the housing sections, and the at least one wire retention pin is fixed to one of the some tab sections by being crimped such that the plurality of divided pieces of the first pin section are bent outward and pressed against an outer wall surface, on one side of the axial direction, of the one of the some tab sections.

2. The turbine wheel according to claim 1, wherein the at least one wire retention pin is a pin with a stepped structure having a step surface, and is configured such that the step surface is pressed against a wall surface of the one of the some tab sections on a housing section side.

3. The turbine wheel according to claim 1, wherein at least one tab section among the some tab sections having the pin slot has a countersunk portion located at an opening edge portion, on an outer surface side of the at least one tab section, of an end portion of the pin slot on the radially outward side, and the plurality of divided pieces of the first pin section are crimped to the pressed against the countersunk portion.

4. The turbine wheel according to claim 1, wherein the at least one wire retention pin has a hollow portion into which a tool is capable of being inserted, and the plurality of divided pieces of the first pin section are configured to form a circumferential wall of the hollow portion and to be bent outward by an insertion of the tool into the hollow portion.

5. The turbine wheel according to claim 4, wherein the at least one wire retention pin has a chamfered portion at an opening edge portion of the hollow portion in the first pin section.

6. The turbine wheel according to claim 1, wherein the first pin section has two divided pieces, and the at least one wire retention pin is arranged such that an array direction of the two divided pieces is perpendicular to an extending direction of the pin slot.

7. A turbine wheel having attachment sections that are spaced apart at an outer peripheral portion and form mating grooves into which turbine rotor blades are inserted in an axial direction to be fit, the turbine wheel being configured to retain, at the outer peripheral portion, an annular fixation wire to inhibit movement of the turbine rotor blades along the mating grooves, the turbine wheel comprising;

a plurality of tab sections that are provided on one side of the attachment sections in the axial direction and form housing sections together with the attachment sections, the housing sections being opened on both sides in a circumferential direction and on a radially inner side and being capable of housing a part of the fixation wire; and at least one wire retention pin for retaining the fixation wire in the housing sections, wherein some tab sections of the plurality of tab sections each have a pin slot into which the at least one wire retention pin is capable of being inserted, the pin slot extending from a radially inner end toward a radially outward side of each of the some tab sections, the at least one wire retention pin includes:

a first pin section having a width smaller than a slot width of the pin slot, and a second pin section that is provided on one side of the first pin section in an axial direction of the at least one wire retention pin and has a width larger than the slot width of the pin slot, the first pin section has, at a tip portion, a plurality of divided pieces that are capable of being brought away from each other, the at least one wire retention pin is arranged such that the first pin section is positioned in the pin slot and the second pin section is positioned in one of the housing sections, the at least one wire retention pin is fixed to one of the some tab sections with the plurality of divided pieces of the first pin section bent outward, and the first pin section has three or more divided pieces.

8. A wire retention pin fixation method for a turbine wheel having, at an outer peripheral portion, attachment sections that form mating grooves into which turbine rotor blades are inserted in an axial direction to be fit, and tab sections that are provided on one side of the attachment sections in the axial direction such that the tab sections form, together with the attachment sections, housing sections that are capable of housing part of a fixation wire to inhibit movement of the turbine rotor blades along the mating grooves, the wire retention pin fixation method comprising steps of:

inserting a first pin section of a wire retention pin into a pin slot extending from a radially inner end toward a radially outward side of one of the tab sections, in a state in which a second pin section of the wire retention pin is positioned on a side where one of the housing sections is located, the first pin section having a width smaller than a slot width of the pin slot, the second pin section having a width larger than the slot width of the pin slot;

moving the wire retention pin along the pin slot, and causing the wire retention pin to abut on an end portion of the pin slot on the radially outward side; and crimping the wire retention pin such that a plurality of divided pieces at a tip portion of the first pin section of the wire retention pin are bent outward and pressed against an outer wall surface, on one side of the axial direction, of the one of the tab sections, thereby fixing the wire retention pin to the one of the tab sections.

9. The wire retention pin fixation method for the turbine wheel according to claim 8, wherein the plurality of divided pieces of the wire retention pin comprise two divided pieces, and the wire retention pin is arranged such that an array direction of the two divided pieces is perpendicular to an extending direction of the pin slot when the wire retention pin is inserted into the pin slot.

10. The wire retention pin fixation method for the turbine wheel according to claim 8, further comprising steps of:

arranging a shim in a gap between the second pin section of the wire retention pin and one of the attachment sections after the wire retention pin is caused to abut on the end portion of the pin slot on the radially outward side; and taking out the shim after the wire retention pin is fixed to the one of the tab sections.

11. The wire retention pin fixation method for the turbine wheel according to claim 8, wherein the wire retention pin has a hollow portion, a circumferential wall of the hollow portion being formed by the plurality of divided pieces, and the crimping of the wire retention pin such that the plurality of divided pieces are bent outward is conducted by inserting a tool into the hollow portion of the wire retention pin.

* * * * *